US005761812A

United States Patent [19]

Feldman

[11] Patent Number: 5,761,812

[45] Date of Patent: Jun. 9, 1998

[54] SAFETY RAZOR

[76] Inventor: Marcel-Marc Feldman, 8, Rue Picot, 75116 Paris, France

[21] Appl. No.: 701,823

[22] Filed: Aug. 23, 1996

[30] Foreign Application Priority Data

Apr. 17, 1996 [FR] France ..... 96 04788

[51] Int. Cl.[6] ..... B26B 21/20

[52] U.S. Cl. ..... 30/34.1; 30/49; 30/50; 30/346.57

[58] Field of Search ..... 30/34.05, 34.1, 30/32, 49, 48, 50, 54, 51, 62, 64, 66, 346.57; D28/45, 46

[56] References Cited

U.S. PATENT DOCUMENTS

| | | | |
|---|---|---|---|
| D. 269,724 | 7/1983 | Chase et al. . | |
| D. 303,023 | 8/1989 | Sinclair . | |
| 794,934 | 7/1905 | Gaylor . | |
| 1,047,617 | 12/1912 | Cress | 30/62 |
| 1,049,320 | 12/1912 | Arnold | 30/62 |
| 1,184,425 | 5/1916 | Corn . | |
| 1,432,949 | 10/1922 | Behrman . | |
| 1,840,056 | 1/1932 | Rhodes | 30/64 |
| 1,889,100 | 11/1932 | Mills . | |
| 2,055,837 | 9/1936 | Dabroski | 30/346.57 |
| 2,127,010 | 8/1938 | Sampson | 30/346.57 |
| 2,580,058 | 12/1951 | Willhelm . | |
| 2,658,271 | 11/1953 | Bronish . | |
| 2,744,319 | 5/1956 | Cutler . | |
| 2,750,663 | 6/1956 | Coles | 30/346.57 |
| 2,863,213 | 12/1958 | Rypysc . | |
| 3,263,330 | 8/1966 | Ferrara . | |
| 3,783,510 | 1/1974 | Dawidowicz et al. . | |
| 3,821,851 | 7/1974 | Kuhnl . | |
| 3,935,639 | 2/1976 | Terry et al. . | |
| 3,939,560 | 2/1976 | Lyall . | |
| 3,964,160 | 6/1976 | Gordon . | |
| 3,972,115 | 8/1976 | Ross . | |
| 3,975,820 | 8/1976 | Torance . | |
| 4,026,016 | 5/1977 | Nissen . | |
| 4,208,791 | 6/1980 | Van Cleve . | |
| 4,275,498 | 6/1981 | Ciaffone . | |
| 4,281,454 | 8/1981 | Trotta . | |
| 4,347,663 | 9/1982 | Ullmo . | |
| 4,483,068 | 11/1984 | Clifford . | |
| 4,663,843 | 5/1987 | Savage | 30/48 |
| 4,756,082 | 7/1988 | Apprille, Jr. . | |
| 4,854,042 | 8/1989 | Byrne | 30/34.1 |
| 4,903,405 | 2/1990 | Halevy . | |
| 4,976,030 | 12/1990 | Boyd | 30/29.5 |
| 5,542,178 | 8/1996 | Harkleroad | 30/34.1 |

*Primary Examiner*—Hwei-siu Payer
*Attorney, Agent, or Firm*—Kenyon & Kenyon

[57] ABSTRACT

A safety razor having a generally rectangular-shaped head, comprises at least one razor cutting edge arranged on at least one of the longitudinal sides of the head and at least one razor cutting edge arranged on at least one of the transversal sides of the head.

5 Claims, 1 Drawing Sheet

SAFETY RAZOR

BACKGROUND OF THE INVENTION

The invention relates to a safety razor.

SUMMARY OF THE INVENTION

The razor of the invention comprises a head of a generally rectangular shape which has the cutting portion of a razor blade on at least one of its longitudinal sides and is characterized in that the head also has the cutting portion of a razor blade on at least one of its side edges.

In one embodiment of the invention, the blade arranged on the lateral side of the head is movable between two positions, in one position it projects from the head while in the other position it is retracted into the head.

According to another embodiment of the invention, the blade arranged to be movable on the side edge of the head comprises a control pin which projects from the head, two cavities being provided in the head to selectively receive a boss of the movable blade to immobilize it in the projecting position or in the retracted position.

BRIEF DESCRIPTION OF THE DRAWINGS

The invention is shown by way of nonlimiting example in the appended drawings, a brief description of which follows.

DETAILED DESCRIPTION OF THE INVENTION

The object of the present invention is to provide a safety razor which permits easy shaving operations in uneven regions of the face and especially in the region between the nose and the upper lip (e.g. base of the nose, openings of the nostrils) and also permits the cutting of the sideburns near the ears.

According to the invention, and referring to FIGS. 1–4, it is thus provided that the head of generally rectangular shape 1 of the razor comprises not only a blade of which the cutting edge (2) is arranged on one of its longitudinal sides but also a blade (3) which projects from lateral side ($\mathbf{1_2}$) of that head.

Thus, bearing in mind the small dimensions of the width ($\mathbf{1_2}$) and of the blade (3), the head (1) and the blade (3) can be readily positioned and oriented to cut into the base of the hairs at the end of the nostrils without the risk of the blade cutting the base of the nose. This arrangement also facilitates shaving operations all the way round any excrescences of flesh on the face and also in the region round the ears, especially sideburns.

Figure 1:
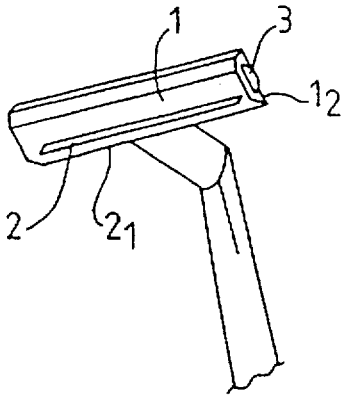
FIG. 1 is a diagrammatic perspective view of one embodiment of the razor of the invention.

Preferably, the small side blade (3) is curved as shown in FIG. 1 in order to permit accurate localization of the cutting region.

The blade (3), which is provided on one or both lateral sides of the head 1, can be moved between two positions in order to be placed in such a manner that it either projects from the head or is retracted into the interior of the head.

Figure 2:
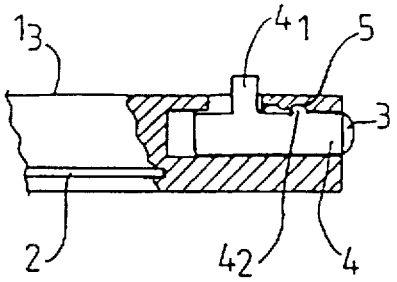
FIG. 2 is a partial cut-away view of another embodiment of the razor of the invention.

FIG. 2 shows the head of a safety razor of which the side blade (3) is molded onto the end of a body of plastic material (4) which is provided with a control pin ($\mathbf{4_1}$) which projects from the upper longitudinal edge ($\mathbf{1_3}$) of the head (1).

The body (4) is also provided with a curved boss ($\mathbf{4_2}$) which can be received selectively in one of two adjacent cavities (5) provided inside the head (1) when the pin ($\mathbf{4_1}$)is actuated. This arrangement enables the blade (3) to be immobilized either in a position projecting from the head, in order to enable it to be used, or in a retracted position in order to prevent the risk of wounds, especially when the main blade (2) is being used for shaving.

According to the embodiment of FIGS. 1 and 2, the side blade 3 is independent of the longitudinal blade (2) but, if desired, and depending on the structure of the head of the safety razor, the blade (3) may be one and the same piece with the blade of which the cutting edge is arranged on one of the longitudinal sides ($\mathbf{2_1}$) of the head (1). As shown, for example, in FIG. 1, the blade (3) extends outward the transverse side of the head of the razor.

Figure 3:
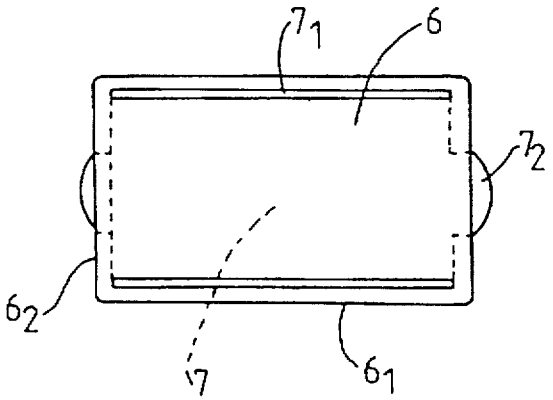
FIG. 3 is a top view of another embodiment of the razor of the invention.
Figure 4:
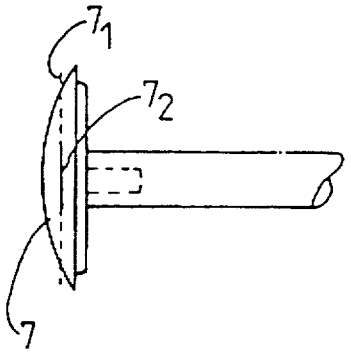
FIG. 4 is a right-hand side view of the razor depicted in FIG. 3.

FIGS. 3 and 4 show an embodiment of the invention in which the head (6) of a safety razor of which the shaving blade (7) has two parallel cutting edges ($\mathbf{7_1}$) arranged along the longitudinal sides ($\mathbf{6_1}$)of the head, while the two side edges of that same blade (7) comprise rectilinear or curved extensions ($\mathbf{7_2}$) which project from the lateral sides ($\mathbf{6_2}$)of the head.

In that case, the width of the extensions ($\mathbf{7_2}$) may represent, for example, only one third or one quarter of the width ($\mathbf{6_2}$) of the head, e.g. approximately 5 mm, in order to permit very localized shaving without the risk of causing wounds to neighboring regions.

According to the examples shown in FIGS. 3 and 4, the blade (7) provided with its side extensions ($\mathbf{7_2}$) is fixed in position inside the head (6).

The blade (7), however, may also be movable longitudinally between two positions over a distance corresponding to the projecting portion of the extension ($\mathbf{7_2}$) in order to be able to retract the extension into the head. In that case, of course, the extension ($\mathbf{7_2}$) would be provided at only one end of the blade (7).

What is claimed is:

1. A safety razor having a generally rectangular-shaped head, the safety razor comprising:

at least one longitudinal razor cutting edge arranged on at least one longitudinal side of the head, and at least one transverse razor cutting edge arranged on at least one transverse side of the head, the at least one transverse razor cutting edge being movable between a retracted position and a projected position, and wherein the head is provided with a first cavity and a second cavity for selectively receiving a boss and the at least one transverse razor cutting edge is connected to a control pin and the boss, the control pin projecting from the head and the boss being selectively receivable into the first cavity and the second cavity so as to immobilize the at least one transverse razor cutting edge in the retracted position or the projected position, respectively.

2. A safety razor having a generally rectangular-shaped head defining a first longitudinal side, a second longitudinal side, a first transverse side, and a second transverse side, the safety razor comprising:

at least one longitudinal razor cutting edge arranged on the first longitudinal side;

at least one transverse razor cutting edge arranged on the first transverse side, the at least one transverse razor cutting edge extending outward from the first transverse side of the head of the razor and disposed for direct contact with the skin and adapted to permit localized shaving in tight regions, the at least one transverse razor cutting edge being disposed on a limited portion of the first transverse side, the first transverse side having non-blade portions on the ends thereof.

3. The safety razor according to claim 2 wherein the second longitudinal side of the head does not have a razor cutting edge.

4. A safety razor having a generally rectangular-shaped head, comprising:

a first blade having a razor cutting edge disposed on a longitudinal side of the head; and a second blade having a razor cutting edge disposed on a transverse side of the head.

5. A razor according to claim 4, wherein the second blade is movable between a retracted position and a projected position.

* * * * *